US012173584B2

(12) United States Patent
Hörman et al.

(10) Patent No.: US 12,173,584 B2
(45) Date of Patent: Dec. 24, 2024

(54) DRIVE DEVICE FOR ROTATABLE OPERATION OF A DRILL BIT OF A DOWN-THE-HOLE HAMMER

(71) Applicant: LKAB WASSARA AB, Huddinge (SE)
(72) Inventors: Magnus Hörman, Älta (SE); Fredrik Egerström, Nacka (SE); Martin Öhnström, Saltsjö-Boo (SE); Magnus Fridsell, Sollentuna (SE)
(73) Assignee: LKAB WASSARA AB, Huddinge (SE)

( * ) Notice: Subject to any disclaimer, the term of this patent is extended or adjusted under 35 U.S.C. 154(b) by 2 days.
(21) Appl. No.: 18/027,038
(22) PCT Filed: Aug. 19, 2021
(86) PCT No.: PCT/SE2021/050816
§ 371 (c)(1),
(2) Date: Mar. 17, 2023
(87) PCT Pub. No.: WO2022/071838
PCT Pub. Date: Apr. 7, 2022
(65) Prior Publication Data
US 2023/0374860 A1 Nov. 23, 2023
(30) Foreign Application Priority Data
Oct. 1, 2020 (SE) ..... 2051146-5
(51) Int. Cl.
*E21B 4/02* (2006.01)
*E21B 4/14* (2006.01)
*E21B 4/16* (2006.01)
(52) U.S. Cl.
CPC ..... *E21B 4/02* (2013.01); *E21B 4/14* (2013.01); *E21B 4/16* (2013.01)
(58) Field of Classification Search
CPC ..... E21B 4/02; E21B 4/06; E21B 4/14
See application file for complete search history.

(56) References Cited

U.S. PATENT DOCUMENTS 2,660,402 A 11/1953 Devine et al.
3,031,975 A 5/1962 Erdmann
(Continued)

FOREIGN PATENT DOCUMENTS

SE 538 166 C2 3/2016
WO 92/14037 A1 8/1992
WO 2016/003350 A1 1/2016

OTHER PUBLICATIONS

International Search Report and Written Opinion issued for International Patent Application No. PCT/SE2021/050816, dated Oct. 18, 2021 in 14 pages.
(Continued)

*Primary Examiner* — Giovanna Wright
(74) *Attorney, Agent, or Firm* — Knobbe, Martens, Olson & Bear, LLP

(57) ABSTRACT

The invention relates to a rotary device (101) for a down-the-hole hammer (1), which rotary device is accommodated in a rotation motor housing (3) and mounted behind a drill housing (2) for transferring a torque to a drill bit (8) and a pressurized drive fluid (22) to a striking mechanism (4) for the drill bit. The rotary device includes a cam curve with a plurality of drive lobes (28:1-28:3) and working chambers (30:1, 30:2, 30:3) along a circumference in the rotation motor housing (3), a rotor disc (38) carrying a plurality of radially movable vanes (40:1-40:12), which are accommodated in piston tracks (41:1-41:12) in the rotor disc. Characteristics of the rotary device are that it includes; an odd integer of a number of drive lobes (28:1-28:3), which is equal to or higher than three; an odd integer of a number of working chambers (30:1, 30:2, 30:3), which is equal to or higher than three; an odd integer of a number of vanes (40:1-40:12), which is equal to or higher than three, and wherein said number of vanes are simultaneously pressurized in each working chamber (30:1, 30:2, 30:3).

10 Claims, 5 Drawing Sheets

(56) References Cited

U.S. PATENT DOCUMENTS

| | | | | |
|---|---|---|---|---|
| 4,105,377 | A | 8/1978 | Mayall | |
| 2005/0092525 | A1* | 5/2005 | Teale | F04C 2/3446 175/57 |
| 2015/0315846 | A1* | 11/2015 | Tulloch | E21B 4/10 175/57 |
| 2018/0058145 | A1* | 3/2018 | Tutt | F04B 1/047 |
| 2019/0195021 | A1* | 6/2019 | Borgen | F03B 13/02 |

OTHER PUBLICATIONS

Search Report for Swedish Patent Application No. 2051146-5, dated Apr. 9, 2021 in 9 pages.

International Preliminary Report on Patentability issued in the corresponding International Patent Application No. PCT/SE2021/050816, dated Apr. 13, 2023 in 8 pages.

Search and Expert Report received in Corresponding Chilean Patent Application No. 2023009188, dated Jul. 31, 2024 in 30 pages.

* cited by examiner

DRIVE DEVICE FOR ROTATABLE OPERATION OF A DRILL BIT OF A DOWN-THE-HOLE HAMMER

CROSS-REFERENCE TO RELATED APPLICATIONS

This application is the U.S. National Phase under 35. U.S.C. § 371 of International Application PCT/SE2021/050816, filed Aug. 19, 2021, which claims priority to Swedish Patent Application No. 2051146-5, filed Oct. 1, 2020. The disclosures of the above-described applications are hereby incorporated by reference in their entirety.

TECHNICAL FIELD

The present invention relates to a rotary device for a down-the-hole hammer which rotary device is accommodated in a rotation motor housing and mounted behind a drill housing included in the down-the-hole hammer with the purpose of both transferring a torque to a drill bit accommodated at the front end of the drill housing and a pressurized drive fluid to a striking mechanism included in the drill housing for the drill bit.

A liquid-powered down-the-hole hammer (down-the-hole drill, DTH) is a compact drill hammer, which is screwed fixedly in a drill string, which, leading up to a drilling rig at ground level, serves as a drilling support and provides the drill with the required drive medium. The down-the-hole hammer is equipped with a drill bit provided with pins, which is located at a front end of a cylindrical drill housing, which accommodates a striking mechanism with the purpose of exerting strokes on the drill bit. In order for the drill bit pins to constantly change contact points and meet new unprocessed rock at each stroke, the drill bit will have to twist or rotate about its own axis. In should be understood that rock cutting in natural rock material differs from other similar drilling in more homogeneous material, as the resistance that the drill bit meets not only occurs intermittently, but also randomly and unpredictably. A device for rotating the drill bit can comprise a pressure fluid-driven displacing fluid dynamic machine of the vane motor type, which, viewed in the drilling direction, is placed in connection with and coupled behind a drill unit comprised by the down-the-hole hammer in order for said rotary device to both transfer a torque on the drill bit of the down-the-hole hammer, and, via a flow divider comprised in the device and a central flushing pipe, also transfer or redistribute a drive flow to the striking mechanism for the drill bit. Said rotary device thereby forms a section unit, which is usually attached to a back-piece at a rear end of the drill housing of the down-the-hole hammer via a fluid-proofing conical pipe coupling. The central rotor shaft of the vane motor is hollow with the dual function of supplying the striking mechanism in the drill housing with pressurized drive fluid (pressure fluid) as well as forming a power transmission, applying a twist motion to the drill bit, where the drill bit follows the rotation of the vane motor.

BACKGROUND

In our own down-the-hole hammer, which is described in Swedish patent specification No. SE 538 166 C2, a rotary device is included with a fluid-driven vane motor accommodated in a rotation motor housing, the stator shell (stator ring) of which alternates between two drive lobes or so-called cam lobes along its circumference and thereby also between two effective working chambers for the rotor's radially displaceable vanes or so-called blades. By means of a flow divider, the pressure fluid that is added via an inlet port at a rear end of the rotary machine housing is distributed in parallel flows between the vane motor and the striking mechanism, which means that each of said machines (striking mechanism and vane motor, respectively) obtains a separate pressure flow and can thus work independently of each other. Due to said parallel flows, the down-the-hole hammer thereby uses so-called open driving systems, wherein the consumed drive fluid for both the rotary device and the striking mechanism of the rotary device is directed out via a respective drain port and is used as flushing fluid to flush out generated drill cuttings from the formed drill hole.

The prior art embodiment outlined above has proven to be well-functioning in down-the-hole drilling. The drill bit can be rotated at a high torque at low revolution speed, offers efficient start and stop and enables reversal of the rotational direction of the drill bit. Even though the prior art embodiment has turned out to function well, there is always an ambition to further improve and make such rotary devices more efficient. In the configuration of rotary devices in general and vane motors for down-the-hole drills in particular, the aim is to obtain as compact and efficient machines as possible. This involves efforts to obtain space for arranging the vanes in such a manner that the machine can have as large an efficient driving vane area as possible relative to the construction length, casing size and weight of the machine.

SUMMARY OF THE INVENTION

The object of the present invention is to achieve a rotary device for a down-the-hole drill, which makes it possible to achieve a more efficient and compact machine.

This object of the invention is resolved by the rotary device having the features and characteristics stated in claim 1. Further advantages of the invention appear from the dependent claims 2-10.

Surprisingly, it has turned out that a vane motor, which is arranged to rotatably drive a drill bit in a down-the-hole hammer, but which instead of, in a conventional manner, comprising two or an even number of drive lobes along its cam curve in a stator ring, also has at least three drive lobes connected or an odd integer of a number of drive lobes higher than three and can offer a number of positive advantages and properties in a down-the-hole drill. This means that the selected number of drive lobes is an odd integer in the formula $n=2k+1$ wherein k is an integer. Correspondingly, the down-the-hole hammer can include three working chambers or an odd integer of a number of working chambers, which are equal to or higher than three for the vanes of the rotor working under application of pressure. Part of the principal idea behind the invention herein is to always have an odd integer of a number of vanes, which is equal to or higher than three, and which set-up is simultaneously pressurized in each working chamber instead of two in order to in this manner obtain an improved hydraulic stability of the machine. Not least, it has hereby turned out to be possible, in a better way, to control the intermittently occurring resistance, which may occur in the drill bit in connection with changing contact points in the rock during rotation. In practice, the following positive effects have been observed; substantially more stable operation, improved low-revolution properties, higher torque at the same construction length and casing size as a corresponding motor with two drive lobes, lower number of revolutions during clearance and improved drilling speed.

Moreover, it has also turned out that the spring component or the expansion element usually sitting behind each moveable vane displaceable in the radial direction of the vane motor in order to particularly at start in radial direction at a certain force to reinforce the outwardly acting centrifugal force and thereby substantially press said vane against an internal envelope surface of the cam curve included in the vane motor, can be dispensed with. Said practical experiments have shown that a motor with three drive lobes is much easier to start at a low number of revolutions, even with the absence of said spring component. The further details of the factors resulting in the latter positive technical effect are not completely unraveled at this staged, but it makes it possible to utilize the space in the rotor of the vane motor, which has hitherto be used for containing said spring components in a more efficient manner for the motor by accommodating vanes with larger effective area while keeping the casing size of the machine. The knowledge mentioned above was not at all obvious but very surprising.

Within the framework of the invention, it is imaginable that a vane motor of a down-the-hole drill, where the number of cam lobes in the stator shell is an odd integer, which is equal to or higher than three and thereby exceeds the three cam lobes described in this exemplary embodiment of the invention, could affect the function and performance of the down-the-hole drill in a positive direction. Practical experiments show that the operation becomes more even and more balanced with more vanes in the machine, but at a certain expense of the torque.

In an embodiment, a circumferential cam curve includes three drive lobes, which between them delimit three working chambers, implying that the cam curve lacks mirror symmetry as to the distribution of the drive lobes along the circumference of the cam curve (cf. the absence of mirror symmetry of e.g. a five-armed starfish). The improved operation properties of a down-the-hole drill, which were surprisingly obtained in practical experiments, are probably due to the vane motor, with three simultaneously pressurized vanes in each working chamber, offering a power/moment balance, which in a desired way corresponds to the randomly varying resistance that occurs when the drill bit changes contact points in natural rock. This improved balance can actually be compared with the constant good balance of a three-legged stool, even if any of the legs differs from the others as regards measure of length.

In another embodiment, a rotor shaft on a rotor disc carries such a large amount of vanes along its circumference that three vanes are pressurized at the same time in each working chamber.

In another alternative embodiment a rotor disc carries at least three vanes, which at the same moment each is in a different state facing a respective lobe changing area 128:1-128:3 along an internal envelope surface of a circumference in the rotation motor housing.

In yet another alternative embodiment, the rotary device lacks the spring component or the expansion component usually sitting behind each movable vane displaceable in radial direction.

DESCRIPTION OF THE INVENTION

Figure 1:
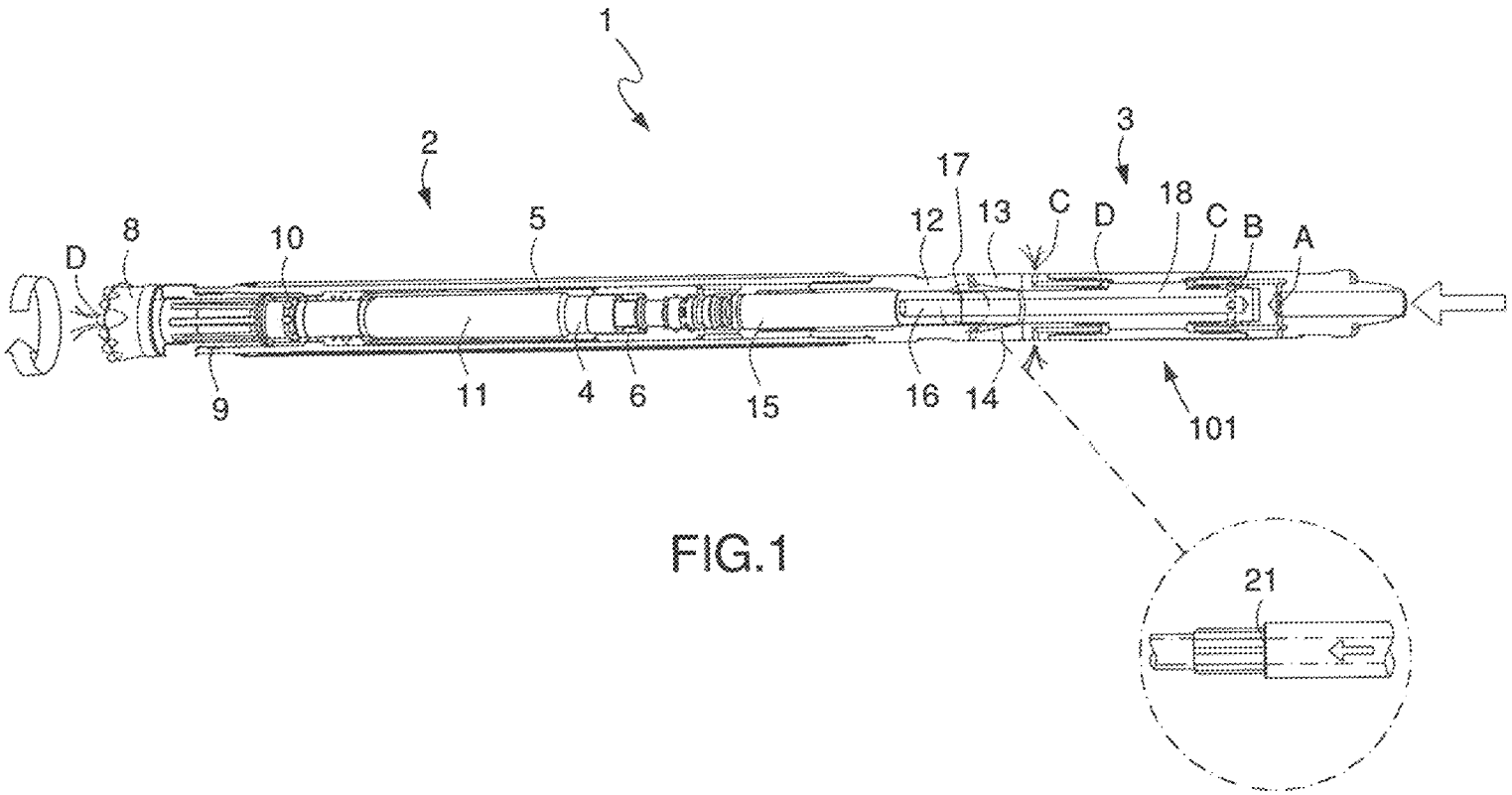
FIG. 1 shows a view in cross section of a fluid-driven down-the-hole hammer, which is configured as a drilling aggregate and comprises a drill housing at a front end as well as rotation motor housing at a rear end with a rotary device according to the present invention.

With reference to FIG. 1, a fluid-driven down-the-hole hammer is generally denoted 1, which forms a drilling aggregate, consisting of a combination of a front drill housing 2 and a rear rotation motor housing 3. The front drill housing 2 is defined by a cylindrical pipe, which at a front end accommodates a pressure fluid-driven striking mechanism 4 with a hammer housing 5 and at a rear portion a valve housing 6 with a valve. A drill bit 8 is, in a rotatably resistant manner, attached in a chuck 9 at the front end of the drill housing 2. At its rear end, the drill bit 8 has a neck 10, which is intended to receive impact energy from a reciprocating moveable percussion piston 11. Through the effect of said valve in the valve housing 6, two drive surfaces (not shown) of the percussion piston 11 facing away from each other are pressurized in an alternating manner with pressure fluid, whereby said reciprocating movement of the percussion piston is obtained. At the rear end of the drill housing 2, there is a back-piece 12.

To said back-piece 12, a front end 13 of the rotation motor housing 3 is fluid-sealingly connected via a threaded conical pipe coupling 14. Through the drill aggregate 2 a hollow drill shaft 15 extends centrally, whose hollow interior forms a central flushing channel 16. The central drill shaft 15 is divisible at 17 in connection with said pipe coupling 14 between the drill housing 2 and the rotary machine housing 3, which are thereby mountable to each other as section units. A vane motor 18 with a rotor shaft 20 is included in the rotation motor housing 3. The torque from said rotor shaft 20 can thereby be transferred to the drill bit 8 via the central drill shaft 15, when said respective shafts 15, 20 are interconnected. In the exemplary embodiment shown here, the divisible coupling at 17 includes a divisible hollow beam unit in the form of a splined coupling 21, which more clearly appears from the partial enlargement in FIG. 1.

Due to the central divisible shaft 15 comprised in the splined coupling 17 being hollow, an extension rearward of the drill housing 2 central flushing channel 16 a distance into the rotary machine housing 3 (see also FIG. 2 and FIG. 3) is formed.

Figure 2:
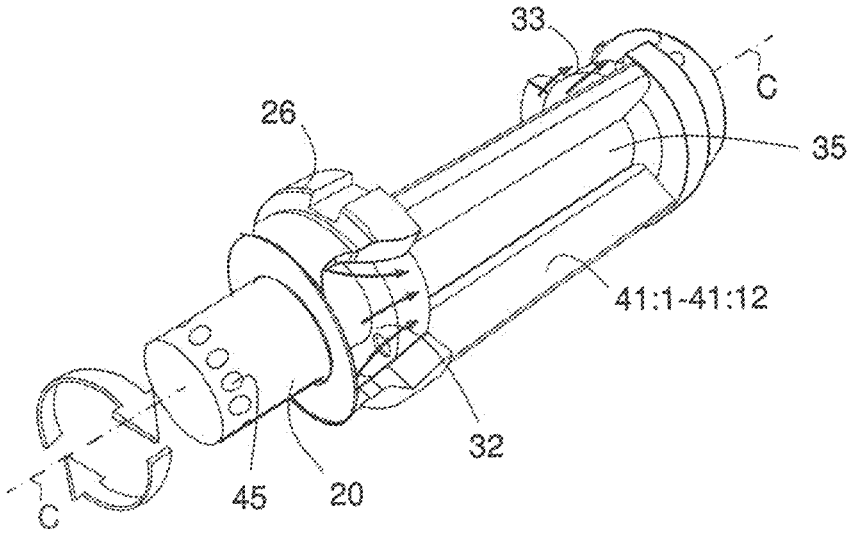
FIG. 2 shows a perspective view of a rotor shaft rotatably bedded and accommodated in the rotation motor housing with an inlet port and an outlet port, respectively, for a pressurized drive fluid, and which rotor shaft has a rotor disc with a series of radially directed vanes, which are radially movably accommodated in corresponding vane piston tracks arranged in a row evenly spaced along the circumference of the envelope surface.
Figure 3:
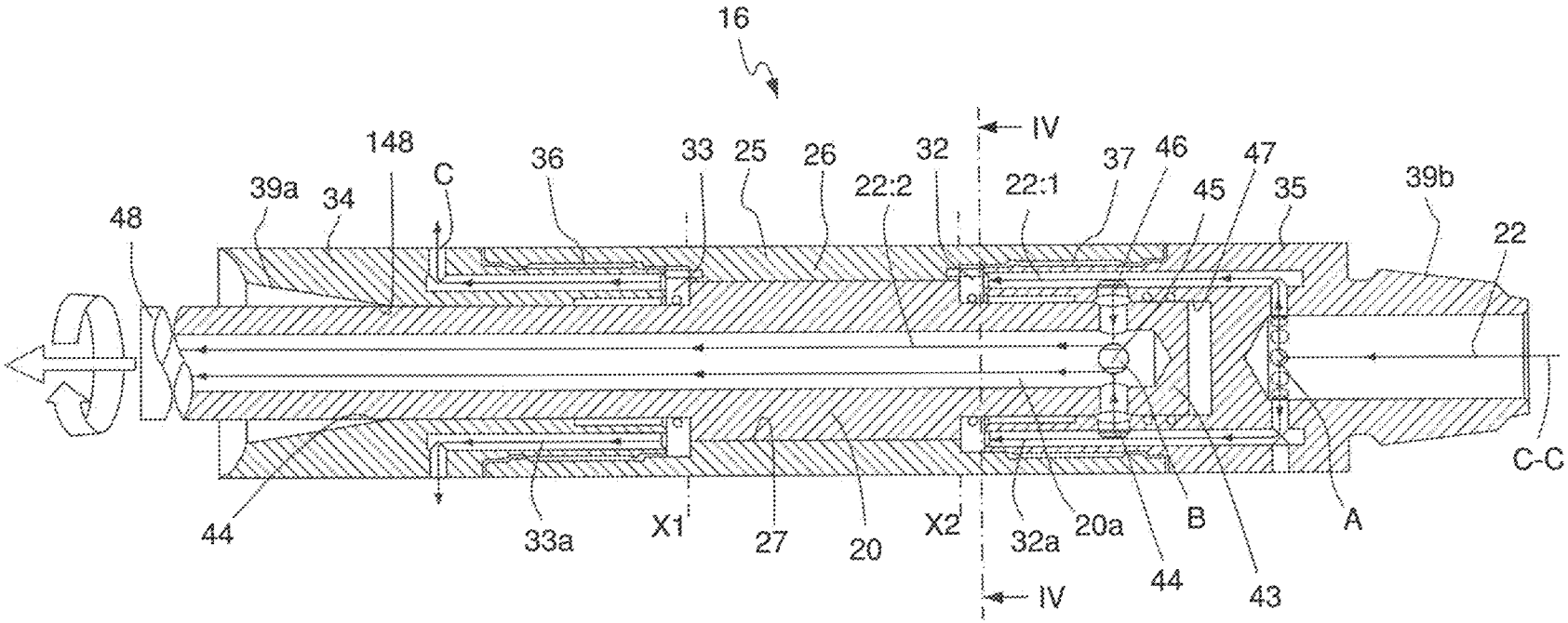
FIG. 3 shows a longitudinal sectional view through a rotation motor housing, which is included in a rotary device according to the present invention.

With reference to FIGS. 2 and 3, a first inlet port for drive fluid is denoted A, and a second inlet port for drive fluid is denoted B. Both of these ports A, B are arranged in a second gable end 35 of a rotary device 101 and together form, purely functionally, a distributor, with which a first a partial flow 22:1 of drive fluid 22 is directed to the vane motor 16 and in parallel hereto a second partial flow 22:2, which, via the central flushing channel 16, is directed to the striking mechanism 4. An inlet port is denoted 32, and an outlet port is denoted 33 for the vane motor 18. Said outlet port 33 is terminated in a drain port C, which leads through the cylindrical outer casing of the rotation motor housing 3.

A rotary device according to the invention is thus arranged in connection with an coupled behind the drill unit 2 included in the down-the-hole hammer 1 in order to both transfer a torque on the drill bit 8 included in the down-the-hole hammer and a pressurized drive fluid to the striking mechanism 4 for the drill bit 8 included in the down-the-hole hammer. The rotary device as well as the down-the-hole hammer can suitably, but not necessarily, include open driving systems, i.e. the type of system where consumed drive fluid is directed out via a first drain port D in a front surface of the drill bit 8 and said second drain port C. The consumed drive fluid that flows out from said drain ports C, D is used as flushing fluid to flush out generated drilling cuttings from the formed drill hole. As illustrated by the arrow 22, a pressurized drive fluid (pressure fluid) in the form of water under pressure enters from a power source at a drilling rig (not shown) connected at the second end of the drill string.

The drive assembly accommodated in the rotation motor housing 3 includes a pressure fluid-driven vane motor 18.

Figure 4:
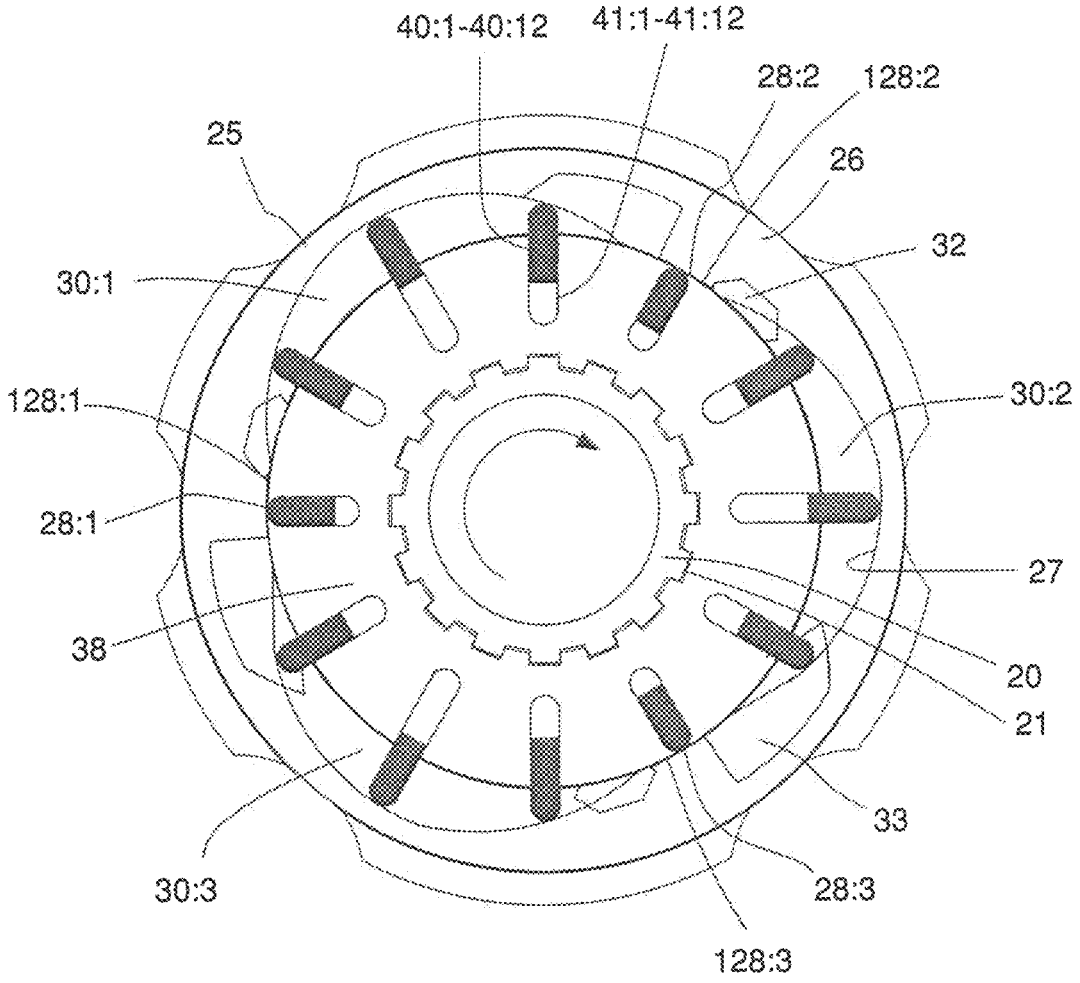
FIG. 4 shows a cross-sectional view through a rotary device according to the present invention, viewed along the boundary lines IV-IV in FIG. 3.

With reference to FIG. 4, it is shown in more detail that the motor housing of the vane motor 18 is delimited in radial direction by an annular stator shell portion 25, which at the same time forms an internal stator ring 26 that on its internal envelope surface 27 has a cam curve with three drive lobes 28:1, 28:3, 28:3, which are evenly spaced along the circumference of the internal envelope surface 27. In the exemplary embodiment described herein, the annular stator shell portion 25 and the internal stator ring 26 are integrally formed, wherein the exterior of the stator shell portion 25 at the same time forms a cylindrical outer envelope surface of the rotation motor housing 3 configured as a section unit. On the rotor shaft 20 shown in FIG. 3, a part of a sideways or relative to the centre axis C-C axially oriented inlet port of the rotary device is denoted 32, and a part of another sideways or axially oriented outlet port 33 for the pressurized drive fluid 22 that is directed via the partial flow 22:1 is denoted 33. The terms sideways or axially directed hereby mean that each of said inlet ports and outlet ports are oriented so that their axial directions coincide with the axial direction of a centre axis C-C through the rotary device, but that they are at a radial distance from the same.

Also, with reference to FIG. 3, showing in more detail that the motor housing of the vane motor 18 is delimited in the axial direction by a first end gable portion 34 and a second end gable portion 35, respectively, which via threaded connections 36 and 37, respectively, are combined with the annual stator shell portion at two transversal division planes X1, X2 spaced apart, so that said portions between them and the annual stator shell portion 25 and a rotor disc 38 carried by the rotor shaft 20 or integrally formed with it form three working chambers 30:1, 30:2, 30:3. In said working chambers 30:1, 30:2, 30:3, a series of twelve radially directed vanes 40:1-40:12 operate, which are radially movably accommodated in corresponding vane piston tracks 41:1-41:12 in the rotor disc 38 and arranged in a row evenly spaced apart along the circumference of the rotor disc 38.

The rotor shaft 20 is via beddings (not shown) rotatably bedded in said first 34 and second end gable portion 35, respectively, of the stator shell 25. The threaded connections 36, 37 of the stator shell 25 at the ends are configured as internal threads to form female parts at mounting of said end gable portions 34, 35 of the mainly tubular stator shell 25. To fit into said threaded connections 36, 37, both end gable portions 34, 35 are correspondingly configured as male parts with external threads at one end. For threaded connection to the conical threaded pipe coupling of in the drill housing 2 in the back-piece 12, said first end gable portion 34 is configured with a pipe coupling 39*a* corresponding to said back-piece 12 at its second end facing the drill housing 2. For threaded connection with the free end of a drill string (not shown), said second end gable portion 35 is configured with a pipe coupling 39*b* corresponding to said drill string end at its second end.

As most clearly appears from FIG. 4, each working chamber 30:1, 30:2, 30:3 is delimited between two successive lobes or lobe switches 128:1-128:3 along the circumference of the stator ring 26, wherein each working chamber 30:1-30:3 has an axially oriented inlet port 32 and outlet port 33, respectively, for a pressurized drive fluid. As mentioned above, the rotor disc 38 can carry twelve radially movable vanes 40:1-40:12, which are evenly distributed along the circumference of the rotor disc 38 and configured for cooperation with the internal envelope surface of the stator ring 26 during each revolution. Each vane 40:1-40:12 is accommodated in a correspondingly shaped vane piston track 41:1-41:12 in the rotor disc 38.

In the embodiment of the invention described here, three vanes 40:1-40:12 are simultaneously pressurized in each working chamber 30:1-30:3, while each of three vanes 40:1-40:12 at the same moment is facing a respective lobe switching area 128:1-128:3 along the circumference of the stator ring 26, a vane 40:1-40:12 in a respective lobe switching area 128:1-128:3. This operation mode is illustrated in FIG. 4 and should be evident if said figure is studied closely.

According to the invention, it has in an embodiment turned out to be advantageous that the rotary device includes at least one of the following characteristics; an odd integer of a number of drive lobes 28:1-28:3, which is equal to or higher than three; an odd integer of a number of working chambers 30:1, 30:2, 30:3, which is equal to or higher than three; an odd integer of a number of vanes 40:1-40:12, which is equal to or higher than three, and where said number of vanes are simultaneously pressurized in each working chamber 30:1, 30:2, 30:3. In another embodiment of the invention, it has turned out to be suitable that the rotary device includes a combination of each of the characteristics stated above.

Furthermore, it has according to the invention proven possible to use vanes 40:1-40:12 with an absence of the spring component (not shown) usually sitting behind each moveable vane displaceable in the radial direction of the vane motor to particularly at start, in the radial direction with a certain spring force to press said vane against the stator ring's 26 internal envelope surface 27 and cam curve.

As shown in FIG. 4, the radially outermost free edge of each vane 40:1-40:12 can moreover be rounded to reduce the frictional force that usually occurs between the vane and the internal envelope surface's 27 circumference of the stator ring 26, while said rounding also enables the vane to maintain good contact with the internal envelope surface 27 of the circumference during rotation.

For each working chamber 30:1, 30:2, 30:3, there is an inlet port 32, which is arranged in said second end gable portion 35, and there is an outlet port 33, which is arranged in said second end gable portion 35. Consequently, the present rotary device includes in total at least three inlet ports 32 and three outlet ports 33. Each of said inlet ports 32 and outlet ports 33, respectively, is axially oriented with respect to the centre axis C-C of the rotary device.

One of the advantages of the orientation of said respective ports 32, 33 compared with for example prior art radially oriented ports is that it is possible, according to the invention, to arrange the required number of drive lobes, vanes and working chambers in the machine room of the rotary device without increasing the casing size of the machine.

In addition to said inlet port 32 and outlet port 33, respectively, the first and the second end gable portion 35 include a pair of inflow tracks 32*a* and outflow tracks 33*a*, respectively, which are arranged as axis-directed drillings in the respective end gable portion and disposed at a certain division along a circle, which is coaxial with the centre axis C-C of the rotary device, so that the inlet flow track 32*a* and the inlet port 32 are arranged, so that the inflow track can receive the pressure fluid from the distributor A, B, and similarly the outlet port 33 and the outlet flow track 33*a* are arranged so that the outlet port 33 can receive pressure liquid, so that the medium that flows in the outlet flow track 33*a* can be discharged through the drain C.

FIG. 3 shows how the rotor shaft 20 includes an axially directed central drilling 20*a*, which forms a bottom hole, which in a defined bottom wall 43 terminates the extent of the central flushing channel 16 viewed from the drill bit 8 and further rearwards. Pressurized drive fluid 22 is communicated between the distributor formed by the two ports A, B and the hollow interior of the rotor shaft 20 via an inlet 44 and for which purpose the rotor shaft 20, on the exterior of its circumference in close connection with the bottom wall 43, is provided with an evenly spaced set-up of radially oriented hole openings 45, which lead towards an annular recess 46 in an internal envelope surface 47 of the second end gable portion 35.

The end of the rotor shaft 20, which, viewed from said inlet 44, faces front to the drill bit 8, is terminated in a shaft end 48 that travels through and a portion of which protrudes a distance out from a central hole opening 148 in the first end gable portion 34. The shaft end 48 of the rotor shaft 20 is provided with the one operative portion of said splined coupling 21 for interaction with a second operating portion at a rear end of the drill housing's 2 central drill shaft 15, which is provided with a splined coupling at its rear end corresponding to the interaction. Both the torque and the pressurized drive fluid can hereby be transferred directly from the rotary device 101 3 to the drill arrangement 2 via said interconnected shafts 15 and 20.

Figure 5:
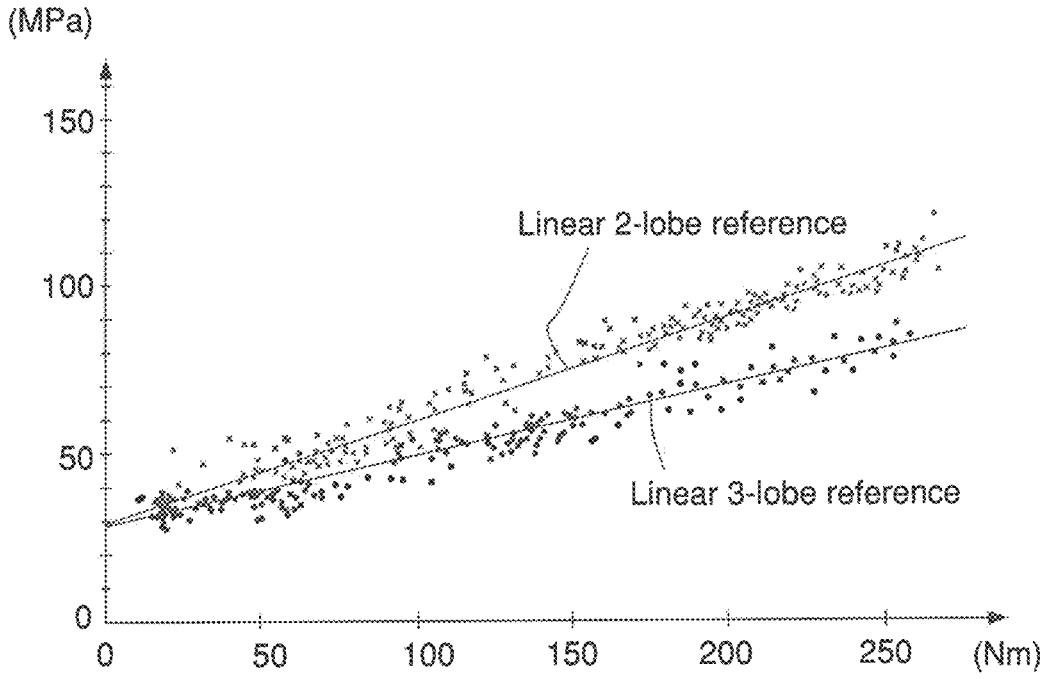
FIG. 5 shows a diagram with marked observations and linear graphs with marked centre lines calculated as group average values in comparison between occurring fluid pressure (MPa) and torque (Nm) for a known rotary device with two drive lobes respectively a rotary device with three drive lobes according to the present invention.

FIG. 5 schematically shows a diagram with marked observations and linear graphs with marked centre lines calculated as group average values in comparison between occurring fluid pressure (MPa) and torque (Nm) for a known rotary device with two drive lobes respectively a rotary device with three drive lobes 28:1-28:3 according to the present invention. The diagram shows that the present rotary device with three drive lobes 28:1-28:3 has a number of advantages that makes it very suitable to use as drive device to obtain rotatable operation of a drill bit of a down-the-hole drill. Among other things, the inclination of the moment curve is substantially flatter for the present rotary device with three drive lobes 28:1-28:3, which means that it can work at a large torque, even at relatively low working pressure of the drive fluid, which overall means that the drill aggregate as a whole becomes very efficient.

What is claimed is:

1. A rotary device for a down-the-hole hammer, said rotary device being accommodated in a rotation motor housing and mounted behind a drill housing included in the down-the-hole hammer with the purpose of both transferring a torque to a drill bit accommodated at the front end of the drill housing and a pressurized drive fluid to a striking mechanism included in the drill housing for the drill bit, wherein the rotary device includes, a cam curve with a plurality of drive lobes and working chambers along a circumference in the rotation motor housing, a rotor disc carrying a plurality of radially moveable vanes, which are accommodated in vane piston tracks in the rotor disc, wherein:

a number of the drive lobes is an odd integer, which is equal to or higher than three;

a number of the working chambers is an odd integer, which is equal to or higher than three;

a number of the vanes are pressurized simultaneously in each working chamber, the number of vanes that are pressurized is an odd number, which is equal to or higher than three;

an annular stator shell portion, which on a radially directed internal envelope surface of a stator ring has said cam curve, a first end gable portion and a second end gable portion, respectively, which are connected with the annual stator shell portion by two transverse division planes spaced at a distance from each other in a center axis direction (C-C), a rotor shaft extending through the stator shell portion along the center axis is rotatably bedded in the respective said first and second end gable portion, wherein the second end gable portion includes at least three inlet ports for admitting pressurized drive fluid to each working chamber, and the first end gable portion includes at least three outlet ports for discharge of consumed drive fluid from each working chamber, wherein each of said inlet ports and outlet ports has an axial direction coinciding with the axial direction of the center axis through the rotary device, but at a radial distance from said center axis.

2. The rotary device according to claim 1, wherein the rotor disc carries at least twelve radially moveable vanes, which are evenly distributed along the circumference of the rotor disc, and three of which are simultaneously pressurized in each working chamber.

3. The rotary device according to claim 1, having an absence of the spring component or the expansion element usually sitting behind each moveable vane displaceable in the radial direction in order to, particularly at start in a radial direction at a certain force, to reinforce the outwardly acting centrifugal force that affects each vane.

4. The rotary device according to claim 1, wherein the free edge of each vane is rounded to reduce the frictional force that usually occurs between the vane and the internal envelope surface of the circumference of the stator ring.

5. The rotary device according to claim 1, including a plurality of at least three inlet flow tracks respectively a plurality of at least three outlet flow tracks, which are arranged as axially directed drills in the first and the second end gable portion, respectively, and placed at a certain determined spacing along a circle, which is co-axial with the center axis.

6. The rotary device' according to claim 5, wherein the inlet flow track and the inlet port are arranged, so that the inflow track can receive pressure fluid from a fluid distributor constituent in the rotary device and similarly, the outlet port and the outlet flow track are arranged, so that the outlet port can receive the pressure fluid, so that the medium that flows in the outlet flow track can be discharged through a drain constituent in the rotary device.

7. The rotary device' according to claim 1, wherein the first end gable portion and the second end gable portion, respectively, are connected with a stator shell portion via threaded connections.

8. The rotary device' according to claim 1, including an open driving system, wherein consumed drive fluid is directed out via drain openings and is used as flushing fluid to flush generated drilling cuttings out of a formed drill hole.

9. The rotary device' according to claim 1, wherein the drill housing includes a through-going central drill shaft, which at a rear end, via a coupling, is divisibly connected to a front shaft end of the rotor shaft, projecting out through a hole opening in the first end gable portion.

10. The rotary device according to claim 9, wherein the divisible coupling includes a splined coupling, whose constituent central drill shaft and rotor shaft are hollow for directing drive fluid through the coupling.

* * * * *